US007645006B2

(12) United States Patent
Schalk et al.

(10) Patent No.: US 7,645,006 B2
(45) Date of Patent: Jan. 12, 2010

(54) PRINTHEAD LIFT

(75) Inventors: Wesley R. Schalk, Camas, WA (US); Allan G. Olson, Camas, WA (US); Ezra Szoke, Del Mar, CA (US); John J. Cantrell, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 332 days.

(21) Appl. No.: 11/494,923

(22) Filed: Jul. 28, 2006

(65) Prior Publication Data

US 2008/0024530 A1 Jan. 31, 2008

(51) Int. Cl.
*B41J 25/308* (2006.01)

(52) U.S. Cl. ..... 347/8

(58) Field of Classification Search ..... 400/55–60; 347/8

See application file for complete search history.

(56) References Cited

U.S. PATENT DOCUMENTS 6,756,232 B1 * 6/2004 Schermer et al. ..... 436/180
6,840,598 B2 1/2005 Fairchild et al.
6,869,235 B2 3/2005 Kawaguchi et al.
6,874,956 B2 4/2005 Kelley et al.
6,886,897 B2 * 5/2005 Park ..... 347/8
6,964,476 B2 11/2005 Okamot
2004/0017410 A1 1/2004 Kim
2004/0056911 A1 * 3/2004 Fairchild et al. ..... 347/8
2004/0096367 A1 * 5/2004 Schermer et al. ..... 422/100
2004/0155914 A1 8/2004 Nellen et al.
2004/0189726 A1 9/2004 Youn et al.
2005/0110816 A1 5/2005 Silverbrook
2005/0152726 A1 7/2005 Ueda et al.
2005/0206666 A1 9/2005 Takahashi et al.
2005/0253880 A1 11/2005 Nakamura et al.
2006/0232623 A1 * 10/2006 Murcia et al. ..... 347/20

* cited by examiner

*Primary Examiner*—Matthew Luu
*Assistant Examiner*—Justin Seo

(57) ABSTRACT

Various embodiments and methods relating to lifting a printhead are disclosed.

19 Claims, 10 Drawing Sheets

PRINTHEAD LIFT

BACKGROUND

Printers may be used to print on different media having a different thicknesses and different material properties. Appropriately positioning or spacing a printhead with respect to media having different thicknesses or different properties may be difficult and may result in complex and expensive mechanical arrangements.

DETAILED DESCRIPTION OF THE EXAMPLE EMBODIMENTS

Figure 1:
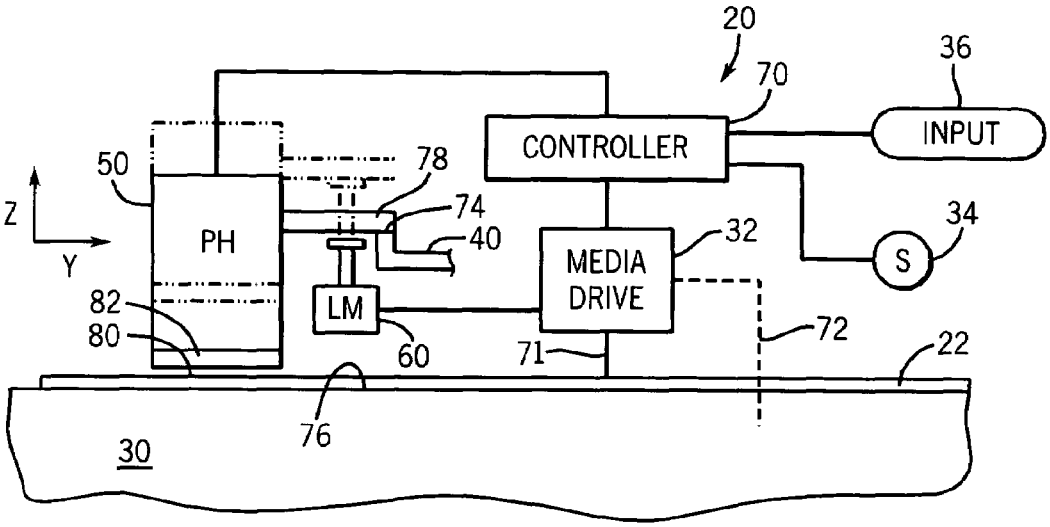
FIG. 1 is a schematic illustration of a printing system according to an example embodiment.

FIG. 1 schematically illustrates one example of a printing system 20. Printing system 20 is configured to print or deposit printing material upon a print medium 22. Print medium 22 may have various thicknesses and surface qualities. As will the described hereafter, printing system 20 adjustably positions one or more print heads to accommodate the various thicknesses and surface qualities of particular media.

Printing system 20 includes media support 30, media drive 32, sensor 34, input 36, support 40, print head 50, lift mechanism 60 and controller 70. Media support 30 comprises one or more structures configured to support a print medium opposite to print head 50. In one embodiment, media support 30 may comprise a stationary platen. In other embodiments, media support 30 may comprise a movable structure such as a movable platen, movable belts or webs or a rotatable drum.

Media drive 32 comprises a mechanism or arrangement of components configured to move print medium 22 relative to printhead 50. In one embodiment in which media support 30 is stationary, media drive 32 may include a source of force or torque, such as a motor and one or more structures, such as rollers, that are rotatably driven by the motor and that physically contact the surface of the print medium 22 as schematically illustrated by line 71. In another embodiment in which media support 30 is itself movable, media drive 32 may comprise a motor and one or more transmission components, such as belts, pulleys, gear trains, chain and sprocket assemblies and the like operably coupling the motor to media support 30 (as schematically illustrated by broken line 72) so as to move media support 30 and the supported print medium 22 relative to printhead 50. In yet other embodiments, media drive 32 may have other configurations.

Sensor 34 comprises a device configure to sense or detect one or more characteristics of print medium 22. In one embodiment, sensor 34 is configured to sense or detect a thickness of print medium 22. In another embodiment, sensor 34 may be configure to sense other characteristics of print medium 22 that may impact a desired spacing of printhead 50 from print medium 22. In other embodiments, sensor 34 may be omitted.

Input 36 comprises one or more devices configured to facilitate the entry or input of information identifying print medium 22 or identifying a thickness or one or more characteristics of print medium 22 that may impact the desired spacing of printhead 50 from print medium 22. In one embodiment, input 36 may comprise a keyboard, a keypad, a mouse, a microphone with appropriate voice recognition software, a touchscreen, or one or more sliders, switches, push buttons and the like. Input 36 may additionally include a display, audio output or other device configure to provide an operator with options for selecting a type of print medium 22 or a characteristic of print medium 22 and for visually or audibly confirming the operator's entry of information regarding print medium 22. In other embodiments, input 36 may be omitted.

Support 40 comprises one or more structures providing surface 74 against which printhead 50 may rest when in a lowered position. The one or more surfaces 74 may have precisely controlled positions with respect to surface 76 of media support 30 so as to provide datums for precisely and more accurately positioning printhead 50 into close proximity with surface 76 and print medium 22 supported by surface 76. Although support 40 and its surface 74 are illustrated as contacting an extension 78 of printhead 50, in other embodiments, surface 74 may alternatively directly contact printhead 50 itself or other structures extending from or coupled to printhead 50 so as to move in a vertical direction with or in response to movement of printhead 50. For example, in one embodiment, surface 74 of support 40 may directly physically contact a carriage (not shown) supporting printhead 50 or a carriage rod (not shown).

Printhead 50 comprises one or more structures configured to deposit printing material upon surface 80 of print medium 22. In one embodiment, printhead 50 comprises an inkjet printhead having nozzles 82 located opposite to surface 80. Nozzles 82 are configured to eject fluid printing material, such as ink, onto surface 80. In one embodiment, printhead 50 is further configured to be scanned along an X-axis (into the page as shown in FIG. 1) across print medium 22. In other embodiments, printhead 50 may comprise a page-wide array printhead extending substantially across print medium 22 in the X-axis direction. In yet other embodiments, printhead 50 may comprise other mechanisms configured to deposit ink or other printing material, such as toner, upon print medium 22.

Lift mechanism 60 comprises one or more mechanisms or components configured to move printhead 50 between a lowered position in which printhead 50 rests upon surface 74 of support 40 as shown in solid lines and a raised position in which printhead 50 is lifted off of surface 74 and is more greatly spaced from surface 76 of support 30 as shown in broken lines. According to one embodiment, lift mechanism derives power from media drive 32, reducing costs and complexity of printing system 20. In such an embodiment, power may be supplied to lift mechanism 60 from media drive 30 upon media drive 32 being driven in a reverse direction. In other embodiments, a clutch and the like may be located between media drive 32 and lift mechanism 60, wherein the clutch (not shown) is selectively actuated by an actuator (not shown) in response to control signals from controller 70 to selectively transmit power to lift mechanism 60.

As further shown with solid lines, lift mechanism 60 is configured to retract and disengage from printhead 50 (or structures which move with printhead 50) when printhead 50 is in the lowered position and is resting upon surface 74 of support 40. As a result, positioning of printhead 50 with respect to surface 76 of support 30 and with respect to surface 80 of medium 22 is substantially controlled by the positioning of surface 74 and is less dependent upon positioning and tolerances associated with lift mechanism 60. Thus, printhead 50 may be more closely and reliably position with respect to surface 80 of medium 22 for potentially improved printing quality.

Controller 70 comprises one or more processing units configured to receive information or signals from sensor 34 and input 36 and further configured to generate control signals based upon such information directing media drive 32 to provide power to lift mechanism 60 to appropriately position printhead 50 with respect to surface 76 of support 30 and surface 80 of medium 22. Controller 70 further generate control signals directing of media drive 30 to appropriately position medium 22 with respect to printhead 50 and control signals directing printhead 50 to deposit printing material upon surface 80 of print medium 22.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 70 is not limited to any specific combination of hardware circuitry and software, nor to any particular source for the instructions executed by the processing unit.

In operation, media to be printed upon is sensed by sensor 34 and signals representing sensed characteristics of medium 22, such as the thickness of the sheet of medium 22, are transmitted to controller 70. Alternatively, an operator or another user for electronic component may identify print medium 22, may provide information regarding the thickness or other characteristics of print medium 22 or may select or enter a desired spacing between printhead 50 and surface 76 or surface 80 via input 36. In response to such information, controller 70 generates control signals causing power to be supplied to lift mechanism 60, whereby lift mechanism 60 raises or lowers printhead 50. For printing upon thin media or when printhead 50 should otherwise be located at its lowered position in which printhead 50 is supported by support 40, controller 70 generates control signals causing lift mechanism 60 to operably disengage printhead 50. Once printhead 50 has been a properly positioned along the Z-axis, controller 70 generate further control signals directing media drive 32 to move print medium 22 relative to printhead 50 along the Y-axis and directing print printhead 50 to deposit printing material upon medium 22.

Figure 2A:
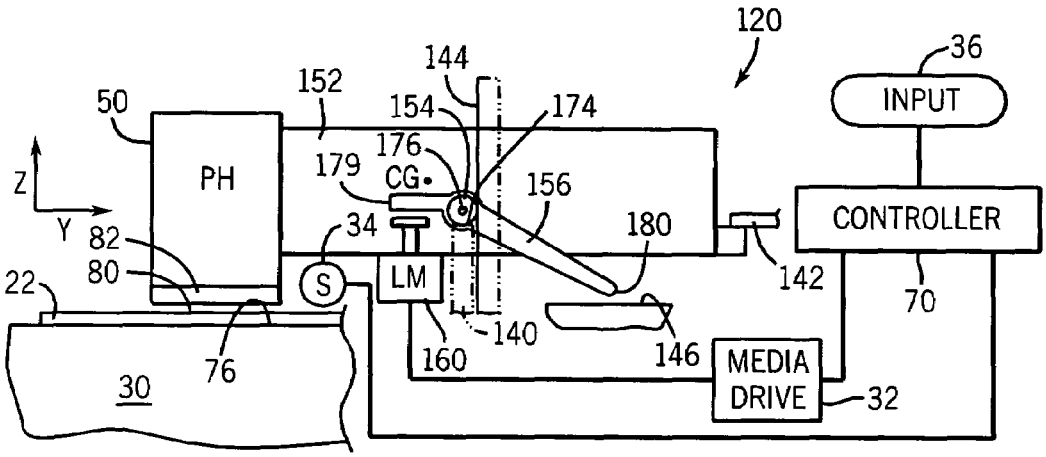
FIG. 2A is a schematic illustration of another embodiment of the printing system of FIG. 1 illustrating positioning of a printhead in a lowered position according to an example embodiment.

FIG. 2A schematically illustrates printing system 120, another embodiment of printing system 20. Like printing system 20, printing system 120 raises and lowers a printhead to accommodate different media. Like printing system 20, printing system 120 has a lift mechanism which disengages the printhead when the printhead is in a lowered position and resting upon a support to provide enhanced accuracy and precision regarding the positioning of printhead 50 with respect to print medium 22. Printing system 120 includes media support 30, media drive 32, sensor 34, input 36, support 140, guide surfaces 142, 144 and 146, printhead 50, carriage 152, carriage rod 154, lever 156, lift mechanism 160 and controller 70. Media support 30, media drive 32, sensor 34, input 36, printhead 50 and controller 70 are substantially similar to similarly named and numbered components of printing system 20.

Support 140 is similar to support 40 of printing system 20 in that printhead 50 rests on support 140 when in a lowered position as shown in FIG. 2A. In particular, support 140 provides one or more surfaces 174 upon which carriage rod 154, which is coupled to printhead 50 so as to support printhead 50, rests under the force of gravity. Surfaces 174 may have precisely controlled positions with respect to surface 76 of media support 30 so as to provide datums for precisely and more accurately positioning printhead 50 into close proximity with surface 76 and print medium 22 supported by surface 76.

Guide surfaces 142, 144 and 146 locate and position or orient printhead 50, carriage 152, carriage rod 154 and lever 156 with respect to the X, Y and Z axes during movement of such components. In one embodiment, such surfaces are fixed to one another as part of a general frame. In one embodiment, such surfaces are integrally formed as part of a single unitary body with one another as part of a frame. In yet other embodiments, such surfaces may be independently supported or may be mounted to a common support structure or base.

Guide surface 142 comprises a substantially horizontal surface against which and along which carriage 152 rests and slides. Guide surface 142 orients carriage 152 and printhead 50 about axis 176 of carriage rod 154 to control the orientation of printhead 50 about axis 176. In particular, surface 142 comprises an anti-rotation surface limiting the extent to which carriage 152 and printhead 50 pivot about axis 176. In the particular example illustrated in which printhead 50 scans across print medium 22 along the X-axis, surface 142 slightly guides movement of carriage 152. Because surface 142 is substantially horizontal, printing system 120 has a lower profile or height as compared to use of a vertical anti-rotation surface.

Figure 2B:
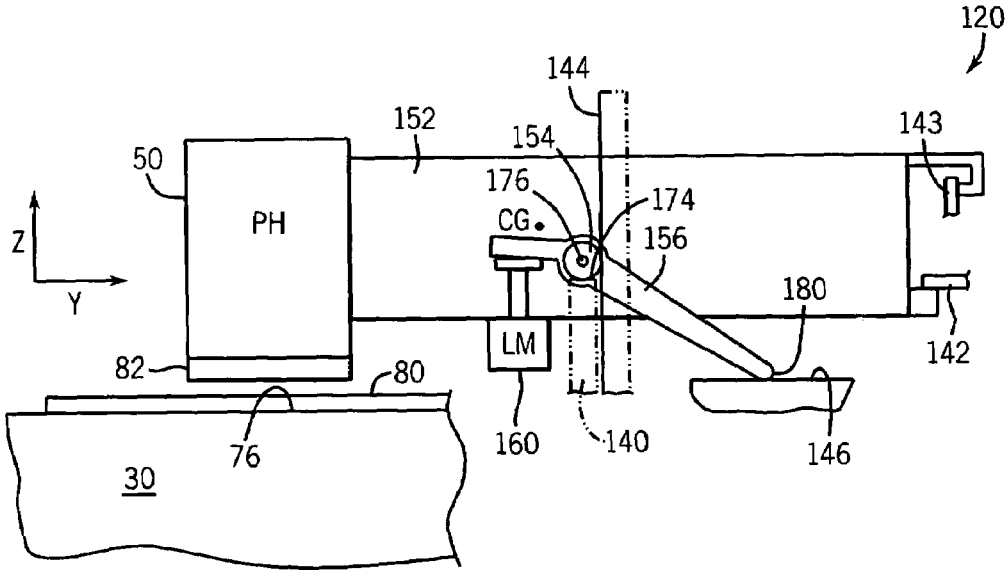
FIG. 2B is a schematic illustration of the printing system of FIG. 2A illustrating pivoting of a lever by a lifting mechanism according to an example embodiment.

In other embodiments, printing system 120 may additionally or alternatively include guide surface 143 (shown in FIG. 2B). Guide surface 143 comprises one or more surfaces against and along which carriage 152 (or structures extending from are coupled to carriage 152 so as to move with carriage 152) slide. Because guide surface 143 is vertical rather than horizontal, guide surface 143 assists in maintaining a level or other predetermined orientation of carriage 152 and printhead 50 about axis 176 of carriage rod 154 as carriage rod 154 is pivoted upward.

Guide surface 144 comprises a substantially vertical surface configured to constrain movement of carriage rod 154 in the Y-axis direction. Guide surface 146 comprises a substantially horizontal surface against which lever 156 bears against and pivots. Surface 146 is further configured to permit the engaging portion of lever 156 to slide or otherwise move in the Y-axis direction as lever 156 pivots and as carriage rod 154 vertically moves along surface 144. As a result, surfaces 144 and 146 cooperate to permit raising and lowering of carriage rod 154, carriage 152 and printhead 50 along the Z-axis and along the surface 144 while eliminating or reducing movement of carriage rod 154, carriage 152 and printhead 50 in the Y-axis direction, enhancing positional control over printhead 50 and the resulting printing upon print medium 22.

Carriage 152 comprises a structure configure to removably receive or be releasably secured to printhead 50. In the example illustrated, carriage 152 slides or otherwise moves along axis 176 of carriage rod 154 to facilitate scanning of printhead 50 across print medium 22. Carriage 152 is driven along axis 176 by a carriage drive (not shown). As indicated in FIG. 2A, carriage 152 has a center of gravity CG to one side of carriage rod 176. As a result, carriage 152 bears against guide surface 142 to orient printhead 50. In other embodiments, carriage 152 may be fixedly secured to printhead 50 in a non-removable fashion or may be replaced with other structures extending from printhead 50.

Carriage rod 154 comprises an elongate rigid rod, bar or other structure configured to guide movement of carriage 152 and to support printhead 50 along axis 176. Carriage rod 154 is further configured to rest upon surface 174 of support 140 so as to locate printhead 50 in its lowered position with respect to surface 76 of media support 30 and with respect to surface 80 of print medium 22. Carriage rod 154 is movable along and against surface 144 as carriage rod 154 and associated lever 156 pivot.

Figure 2C:
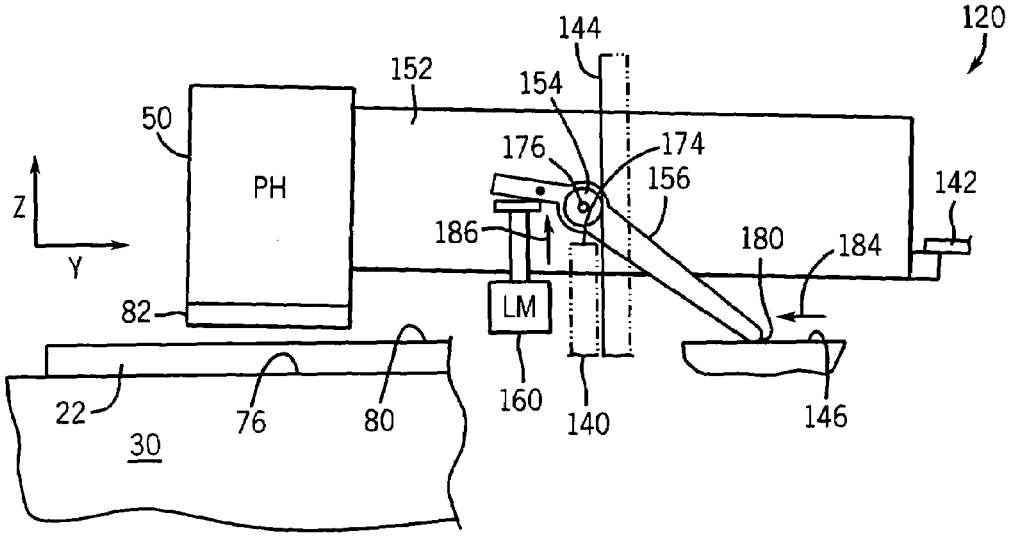
FIG. 2C is a schematic illustration of the printing system of FIG. 2B with further pivoting of the lever by the lifting mechanism to lift a printhead according to an example embodiment.

Lever 156 comprises a structure fixedly secured to carriage rod 154 and extending from carriage rod 154. Lever 156 has an engagement portion 179 on a first side of axis 176 configured to be engaged by lift mechanism 160 and a pivot portion 180 on a second side of axis 176 configured to bear against and slide along surface 146 when lever 156 and carriage rod 154 are being raised or pivoted (as shown in FIGS. 2B and 2C). Lever 156 is further configured to be disengaged from lift mechanism 160 when carriage rod 154 is resting upon surface 174. Lever 156 is configured such that pivot portion 180 disengages surface 146 when carriage rod 154 is resting upon support 140 (as shown in FIG. 2A). Because pivot portion 180 of lever 156 disengages surface 146 when carriage rod 176 rests upon support 140, positioning of carriage rod 154, and ultimately printhead 50, is largely dependent upon the location accuracy of surface 174 and the impact of other part or assembly tolerances upon the positioning of carriage rod 154 and printhead 50 is reduced. The sensitivity of the positioning of carriage rod 154 and printhead 50 to assembly variations and part dimension variations is further reduced because lift mechanism 160 is operably disengaged from lever 156 and carriage rod 154 when carriage rod 154 rests upon support 140. Although lever 156 is schematically illustrated as being an elongate bar or arm, lever 156 may have multiple sizes and configurations.

Lift mechanism 160 is substantially similar to lift mechanism 60 (shown and described with respect to FIG. 1) except that lift mechanism 160 directly engages engagement portion 179 of lever 156 to pivot lever 156 and carriage rod 154 about an axis provided by pivot portion 180 of lever 156. Lift mechanism 160 is configured to disengage lever 156 when carriage rod 154 is resting upon surface 140. At the same time, lift mechanism 160 is configured to lift carriage rod 154 off of support 140 to lift carriage rod 154 and printhead 50. In one embodiment, lift mechanism 160 is coupled to lever 156 so as to exert a vertical force upon lever 156 to pivot lever 156 and carriage rod 154. In yet another embodiment, lift mechanism 160 may be configured to exert a horizontal force upon lever 156 to pivot lever 156 and carriage rod 154. For example, lift mechanism 160 may be configured to exert a horizontal force in a leftward direction (as seen in FIG. 2A) so as to lower pivot portion 180 into engagement with surface 146 and so as to elevate carriage rod 154 along surface 144. Lift mechanism 160 may comprise lifting actuators. For example, lift mechanism 160 may comprise a cam receiving power from media drive 32 and configured to rotate or otherwise move so as to lift or pivot lever 156. In yet other embodiments, lift mechanism 160 may comprise a pneumatic or hydraulic cylinder-piston assembly, a solenoid, or other linear actuator.

FIGS. 2A-2C schematically illustrate operation of printing system 120. FIG. 2A schematically illustrate printing system 120 with printhead 50 in its lowered position. In this position, lift mechanism 160 is disengaged from lever 156. Pivot portion 180 is further disengaged from surface 146. Carriage rod 154 rests upon support 140 while carriage 152 rests upon surface 142 to locate nozzles 82 of printhead 50 in relatively close proximity to surface 80 of print medium 22 for enhanced printing quality.

FIGS. 2B and 2C schematically illustrate adjustment of printing system 120 to accommodate a thicker sheet of print medium 22 as determined by controller 70 from either input to 36 or sensor 34. In particular, controller 70 generates control signals causing lift mechanism 160 to lift lever 156. As shown in FIG. 2B, initial movement of lever 156 does not result in lifting of carriage rod 154 until pivot 180 is brought into engagement with surface 146. This "lost motion" of pivot point 180 facilitates disengagement of pivot point 180 from surface 146. As shown by FIG. 2C, once pivot 180 is lowered into engagement surface 146, further lifting of lever 156 causes lever 156 and carriage rod 154 to pivot about an axis provided by pivot portion 180 against surface 146. Because the axis about which lever 156 and carriage rod 154 pivot (the axis of pivot portion 180) is permitted to move along surface 146 in the direction indicated by arrow 184, carriage rod 154 may vertically move along surface 144 with a more pure vertical movement in the Z-axis direction as indicated by arrow 186. By reducing movement of carriage rod 154 and printhead 50 in the Y-axis direction during lifting of printhead 50 in the Z-axis direction, positional control of printhead 50 and print quality may be enhanced. In the particular embodiment illustrated, the reduced movement of carriage rod 154 and printhead 50 in the Y-axis also facilitates improved servicing and capping of printhead 50.

Figure 3:
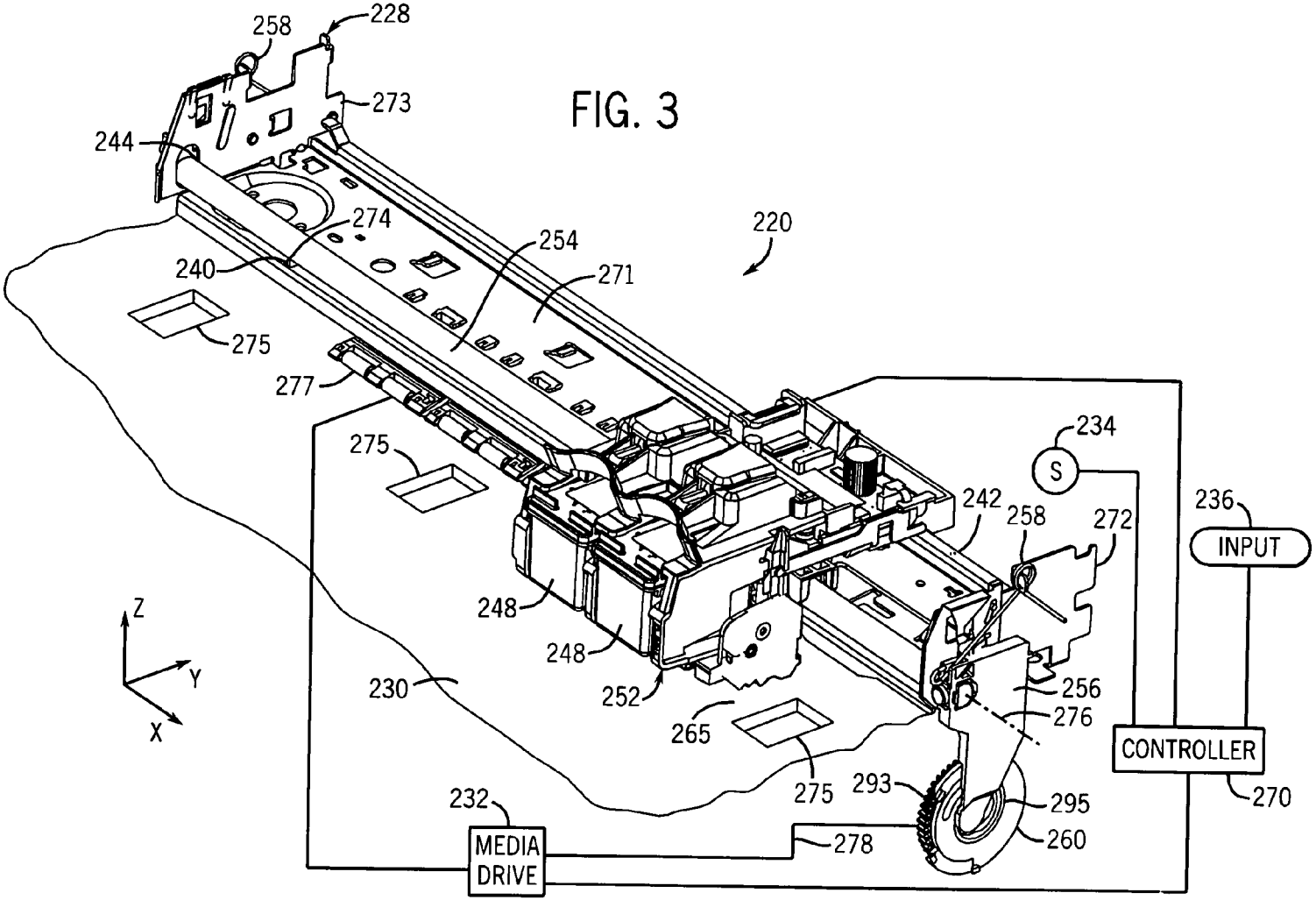
FIG. 3 is an isometric perspective of another embodiment of the printing system of FIG. 1 with portions schematically shown according to an example embodiment.

FIGS. 3-14 illustrate printing system 220, another embodiment of printing system 20. As shown by FIG. 3, printing system 220 includes frame 228, support 230, media drive 232, sensor 234, input 236, supports 240 (one of which is shown in FIG. 3), guide surfaces 242, 244 (shown in FIG. 3 and FIG. 12), 246 (shown in FIG. 4) and 247 (shown in FIG. 14), print cartridges 248, carriage 252, carriage rod 254, levers 256, 257 (shown in FIG. 8), bias members 258, lift mechanism 260 and controller 270. Frame 228 comprises one more structures coupled to and supporting remaining elements of printing system 220. Frame 228 includes a floor portion 271 and side portions 272, 273. Floor portion 271 comprises a substantially horizontal structure along which media may move and from which supports 240 extend. Side portions 272 and 273 extend from floor portion 271 while supporting guide surfaces 244, 246 and 247 and bias members 258. In one embodiment, floor portion 271 and side portions 272, 273 are integrally formed as a single unitary body from a stamped and deformed sheet-metal. In other embodiments, portions 271, 272 and 273 may comprise separate structures fastened, welded, bonded or otherwise joined to one another.

Media support 230 comprises one or more structures configured to support a print medium opposite to print heads of print cartridges 248. In the embodiment illustrated, media support 230 comprises a stationary platen. In one embodiment, media support 230 additionally includes basins or cavities 275 adjacent a print zone of system 220 to facilitate edge-to-edge printing such as when printing photos. In other embodiments, media support 230 may comprise a movable structure such as a movable platen, movable belts or webs or a rotatable drum.

Media drive 232 comprises a mechanism or arrangement of components configured to move a print medium relative to print cartridges 248. Media drive 32 includes a source of force or torque, such as a motor (not shown), and one or more structures, such as rollers 277. In the embodiment illustrated, the motor drives a feed shaft (not shown) towards which rollers 277 are biased, wherein the feed shaft and the rollers 277 physically contact opposite surfaces of the print medium to move the print medium. Although not shown, media drive 232 includes additional rollers or other structures that engage sheets of media to move the sheets from a media supply (not shown) to rollers 277 and from rollers 277 and print cartridges 248 to a media output (not shown). In other embodiments, media drive 232 may have other configurations.

As further shown by FIG. 3, and schematically indicated by line 278, media drive 232 is operably connected to lift mechanism 260 so as to supply power to and drive lift mechanism 260. Because media drive 232 selectively applies power to actuate lift mechanism 260, a separate or dedicated motor for lift mechanism 260 may be omitted, reducing the cost and complexity of printing system 220. In other embodiments, a separate or dedicated motor or source of force may be provided for lift mechanism 260.

Sensor 234 (schematically illustrated) comprises a device configure to sense or detect one or more characteristics of a medium being printed upon, such as print medium 22 (shown in FIG. 1). In one embodiment, sensor 234 is configured to sense or detect a thickness of the print medium. In another embodiment, sensor 234 may be configure to sense other characteristics of the print medium that may impact a desired spacing of the printheads of print cartridges 248 from the print medium. In other embodiments, sensor 234 may be omitted.

Input 236 comprises one or more devices configured to facilitate the entry or input of information identifying the print medium or identifying a thickness or one or more characteristics of the print medium that may impact the desired spacing of the printheads of print cartridges 248 from the print medium. In one embodiment, input 236 may comprise a keyboard, a keypad, a mouse, a microphone with appropriate voice recognition software, a touch screen, or one or more sliders, switches, push buttons and the like. Input 236 may additionally include a display, audio output or other device configure to provide an operator with options for selecting a type of print medium or a characteristic of the print medium and for visually or audibly confirming the operator's entry of information regarding the print medium. In other embodiments, input 236 may be omitted.

Supports 240 comprise structures providing surfaces 274 against which carriage rod 254 may rest when in a lowered position. Surfaces 274 may have precisely controlled positions with respect to surface 265 of media support 230 so as to provide datums for precisely and more accurately positioning print cartridges 248 into close proximity with surface 265 and the medium supported by surface 265. Because supports 240 support carriage rod 254 when carriage rod 254 is in its lowered position, supports 240 also support carriage 252 and print cartridges 248 along with their printheads when print cartridges 248 are also in their lowered positions.

In the embodiment illustrated, supports 240 comprise tabs upwardly extending from floor portion 271. In the embodiment illustrated, supports 240 are stamped from sheet-metal and rigidly attached to media support 230. In other embodiments, supports 240 are integrally formed as part of a single unitary body with floor portion 271 of frame 228, reducing cost and complexity. In particular, supports 240 comprise tabs stamped from sheet-metal and upwardly deformed. In other embodiments, supports 240 may comprise other structures integrally formed with floor portion 271 in other manners or welded, fastened, bonded or otherwise joined to floor portion 271 or media support 230.

Guide surfaces 242, 244, 246 and 247 locate and position or orient print cartridges 248, carriage 252, carriage rod 254 and levers 256, 257 with respect to the X, Y and Z axes (shown in FIG. 3) during movement of such components. In the embodiment illustrated, such surfaces are fixed to one another as part of a general frame. In one embodiment, such surfaces are integrally formed as part of a single unitary body with one another as part of a frame. In yet other embodiments, such surfaces may be independently supported or may be mounted to a common support structure or base.

Guide surface 242 comprises a substantially horizontal surface against and along which carriage 252 rests and slides. Guide surface 242 orients carriage 252 and print cartridges 248 about axis 276 of carriage rod 254 to control the orientation of printheads 248 about axis 276. In particular, surface 242 comprises an anti-rotation surface limiting the extent to which carriage 252 and print cartridges 248 pivot about axis 276. In the particular example illustrated in which print cartridges 248 are scanned across a print medium along the X-axis, surface 242 slidably guides movement of carriage 252. Because surface 242 is substantially horizontal, printing system 220 has a lower profile or height as compared to use of a vertical anti-rotation surface. In other embodiments, printing system 220 may alternatively include a vertical anti-rotation surface such as surface 143 shown in FIG. 2B.

Guide surfaces 244 comprise substantially vertical surfaces configured to constrain movement of carriage rod 254 in the Y-axis direction. In the example illustrated, guide surfaces 244 comprise vertically extending slots formed within the side portions 272, 273. In other embodiments, surfaces 244 may be provided by other structures separate from or mounted to frame 228.

Figure 4:
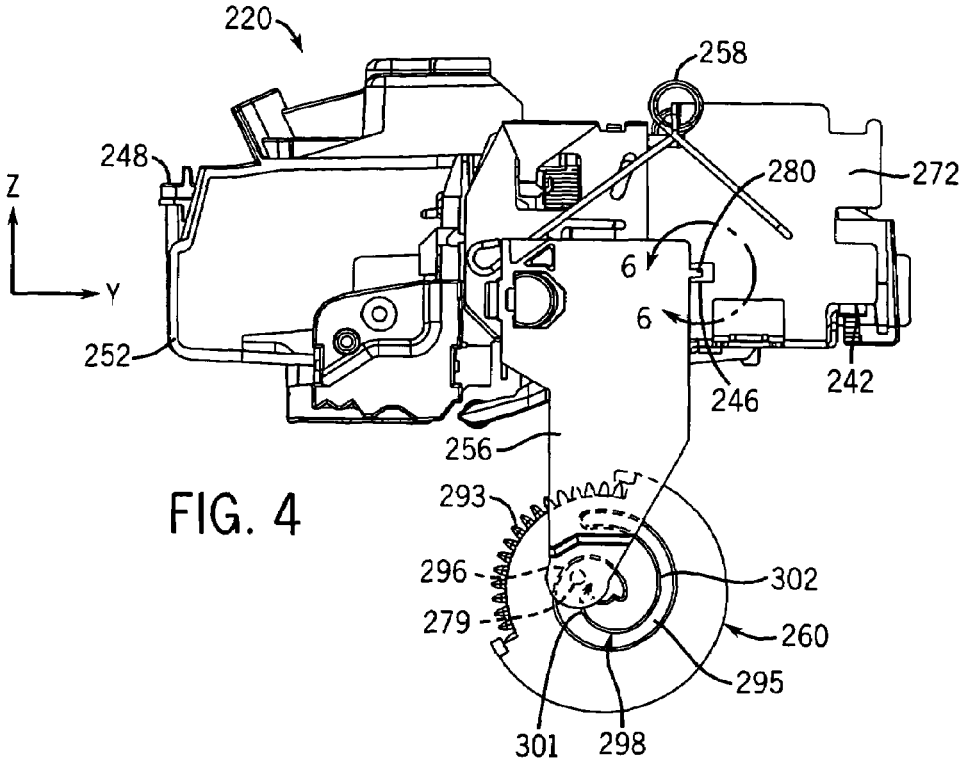
FIG. 4 is a right side elevational view of the printing system of FIG. 3 illustrating print cartridges in a lowered position according to an example embodiment.
Figure 12:
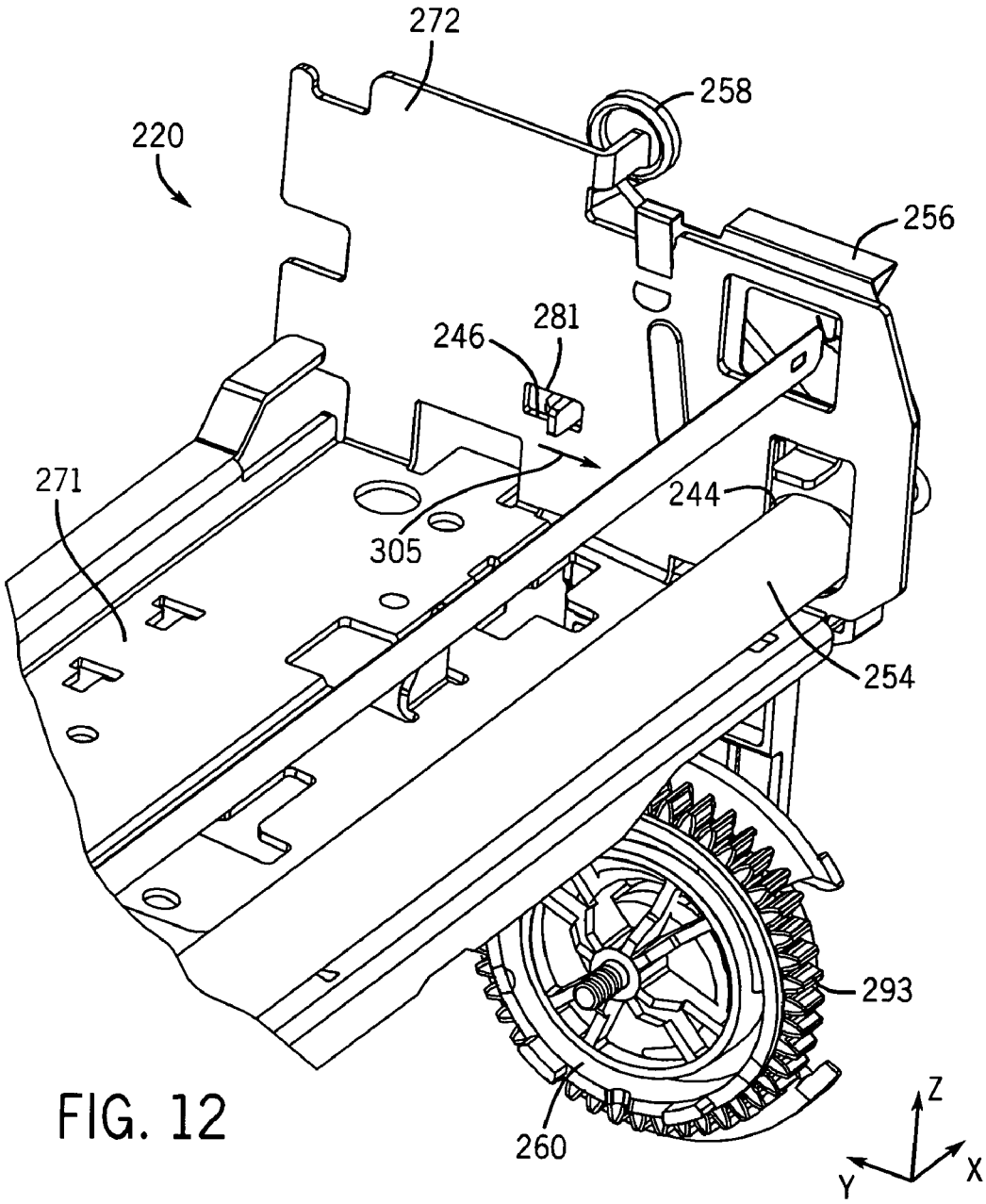
FIG. 12 is an enlarged fragmentary perspective view of a portion of the printing system of FIG. 9 according to an example embodiment.
Figure 13:
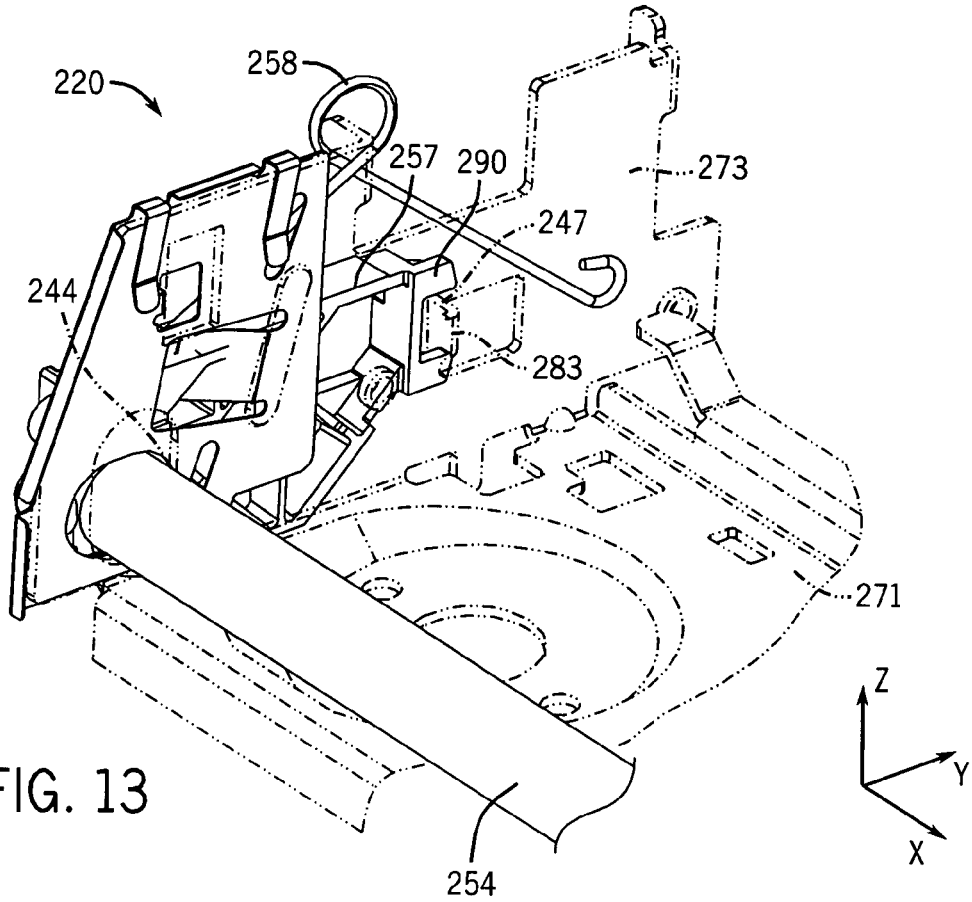
FIG. 13 is a fragmentary perspective view of the printing system of FIG. 3 illustrating a lever and a carriage rod in a lowered position according to an example embodiment.
Figure 14:
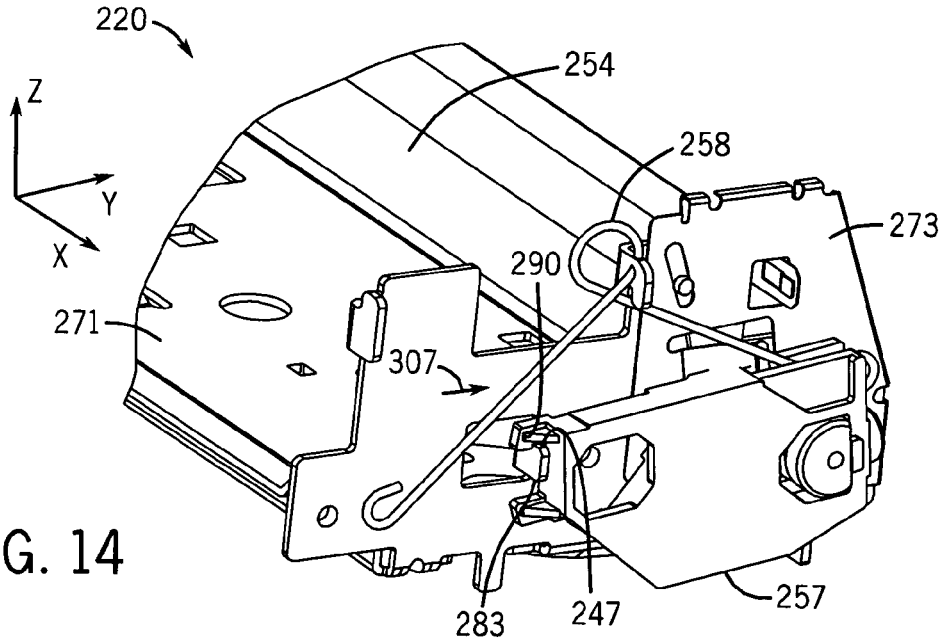
FIG. 14 is a fragmentary perspective view of the printing system of FIG. 9 illustrating a lever and a carriage rod in a raised position according to an example embodiment.

Guide surfaces 246 and 247, shown in FIGS. 4, 12 and in FIGS. 13 and 14, respectively, comprise substantially horizontal surfaces against which levers 256 and 257 bear against and pivot. Surfaces 246 and 247 are further configured to permit engaging portions of levers 256 and 257 to slide or otherwise move in the Y-axis direction as carriage rod 254 vertically moves along surfaces 244. As a result, surfaces 244 and surfaces 246,247 cooperate to permit raising and lowering of carriage rod 254, carriage 252 and print cartridges 248 along the Z-axis and along the surfaces 244 while eliminating or reducing movement of carriage rod 254, carriage 252 and print cartridges 248 in the Y-axis direction, enhancing positional control over printheads 50 (shown in FIG. 1) of print cartridges 248 and the resulting printing upon a print medium.

As shown by FIGS. 4 and 12, guide surface 246 is provided by an elongate cut out or slot 281 formed within side portion 272 of frame 228. Slot 281 has a lower edge providing surface 246. As shown by FIGS. 13 and 14, guide surface 247 is provided by an elongate projection or tab 283 extending from side portion 273 of frame 228. Tab 283 has an upper horizontal edge providing surface 247. In other embodiments, surfaces 246 and 247 may alternatively be provided by other structures.

Print cartridges 248 comprise devices configured to deposit printing material upon a surface of a print medium. Print cartridges 248 each include inkjet printheads 50 (schematically shown in FIG. 1) having nozzles through which ink or other fluid is ejected. In one embodiment, print cartridges 248 are configured to be removably mounted to carriage 252 and to be carried by carriage 252. In the embodiment illustrated, print cartridges 248 each have a self-contained volume of ink or fluid. In other embodiments, print cartridge 248 may alternatively additionally be connected to an off-axis supply of fluid or ink. Although print cartridges 248 are illustrated as being connected to carriage 252 and scanned along an X-axis across the print medium 22, in other embodiments, print cartridges 248 may alternatively comprise a page-wide-array of one or more printheads extending substantially across the print medium in the X-axis direction. In yet other embodiments, print cartridges 248 may be replaced by other mechanisms configured to deposit ink or other printing material, such as toner, upon a print medium.

Carriage 252 comprises a structure configured to removably receive or to be releasably secured to print cartridges 248. In the example illustrated, carriage 252 slides or otherwise moves along axis 276 of carriage rod 254 to facilitate scanning of print cartridges 248 across a print medium. Carriage 252 is driven along axis 276 by a carriage drive (not shown). Carriage 252 has a center of gravity to one side of carriage rod 276 away from guide surface 242. As a result, carriage 252 bears against guide surface 242 to orient print cartridges 248. In other embodiments, carriage 252 may be fixedly secured to print cartridges 248 in a non-removable fashion or may be replaced with other structures extending from print cartridges.

Carriage rod 254 comprises an elongate rigid rod, bar or other structure configured to guide movement of carriage 252 and to support print cartridges 248 along axis 276. Carriage rod 254 is rigidly and immovably connected to levers 256 and 257 while being configured to rest upon surfaces 274 of supports 240 so as to locate print cartridges 248 in their lowered position with respect to surface 265 of media support 230. Carriage rod 254 is movable along and against surfaces 244 as carriage rod 254 and associated levers 256, 257 pivot.

Lever 256 comprises a structure fixedly secured to carriage rod 254 and extending from carriage rod 254 proximate to side portion 272 of frame 228. Lever 256 has an engagement portion 279 on a first side of axis 276 and a pivot portion 280 on a second side of axis 276. As shown by FIG. 4, engagement portion 279 comprises a projection or pin extending from a remainder of lever 256 and is received by an opening in lift mechanism 260. As will be described in more detail here after with respect to lift mechanism 260, engagement portion 279 is disengaged from lift mechanism 260 when carriage rod 254 is resting upon supports 240 and is engaged by lift mechanism 260 during raising of carriage rod 254 and the associated print cartridges 248. Although engagement portion 279 is illustrated as a pin, in other embodiments, engagement portion 279 may have other configurations depending upon the configuration of lift mechanism 260.

Figure 5:
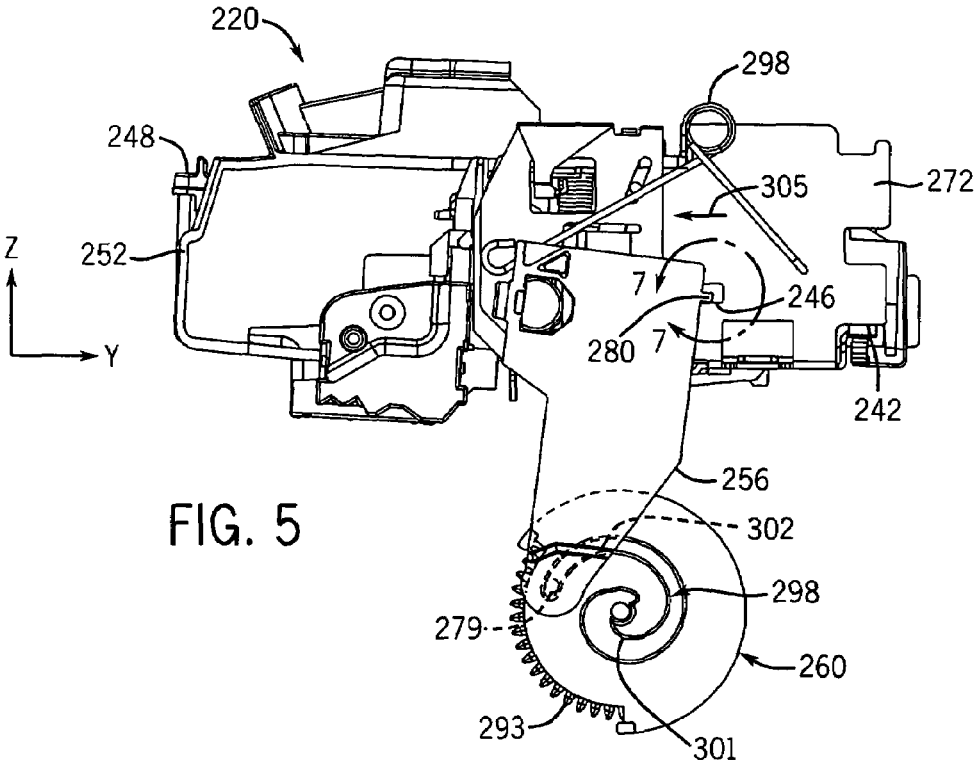
FIG. 5 is a right side elevational view of the printing system of FIG. 3 illustrating print cartridges in a raised position according to an example embodiment.
Figure 6:
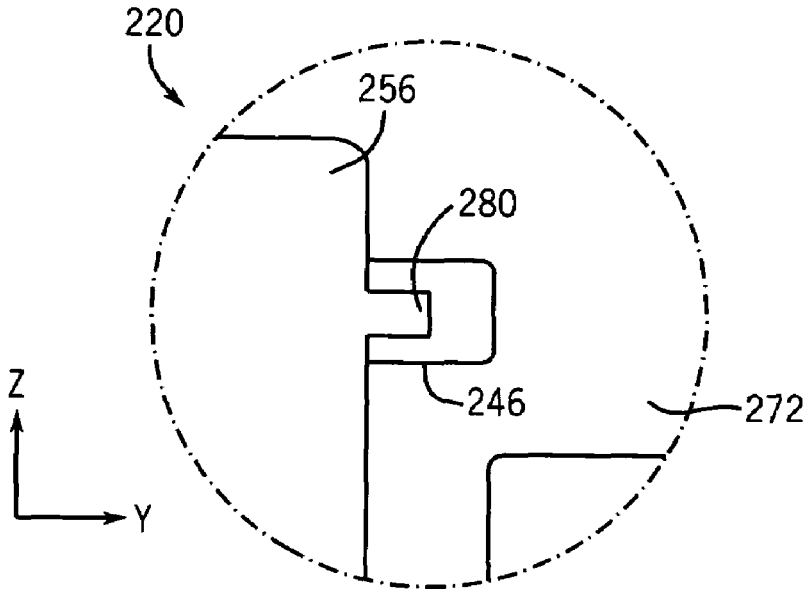
FIG. 6 is an enlarged elevational view of the printing system of FIG. 4 taken along line 6-6 according to an example embodiment.
Figure 7:
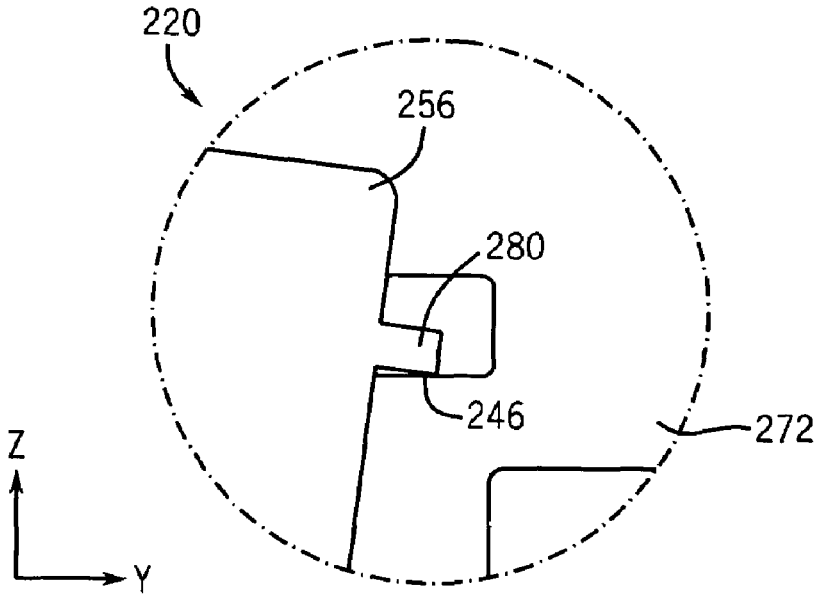
FIG. 7 is an enlarged elevational view of the printing system of FIG. 5 taken along line 7-7 according to an example embodiment.
Figure 8:
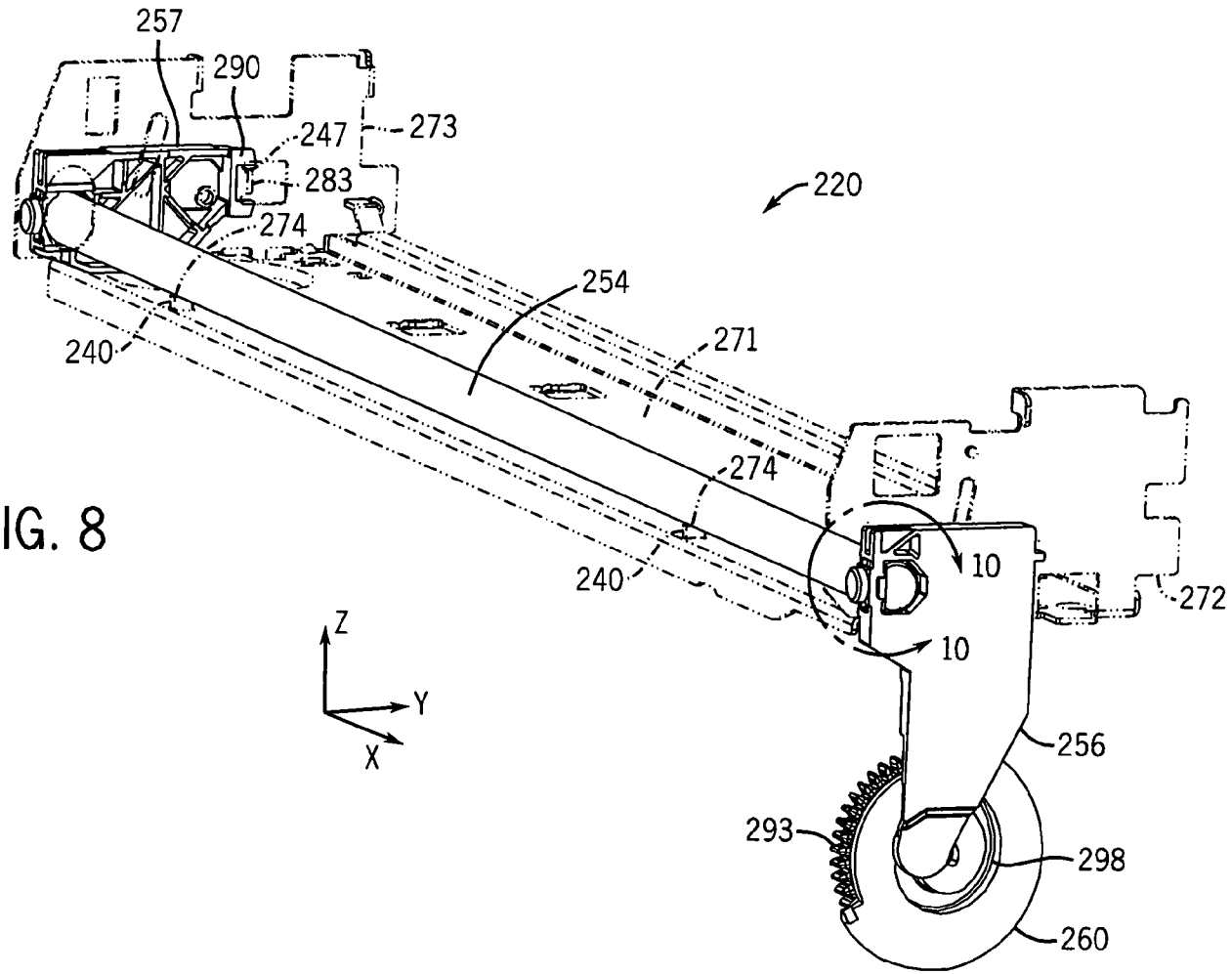
FIG. 8 is an isometric perspective view of a portion of the printing system of FIG. 3 illustrating levers and a carriage rod in a lowered position according to an example embodiment.
Figure 9:
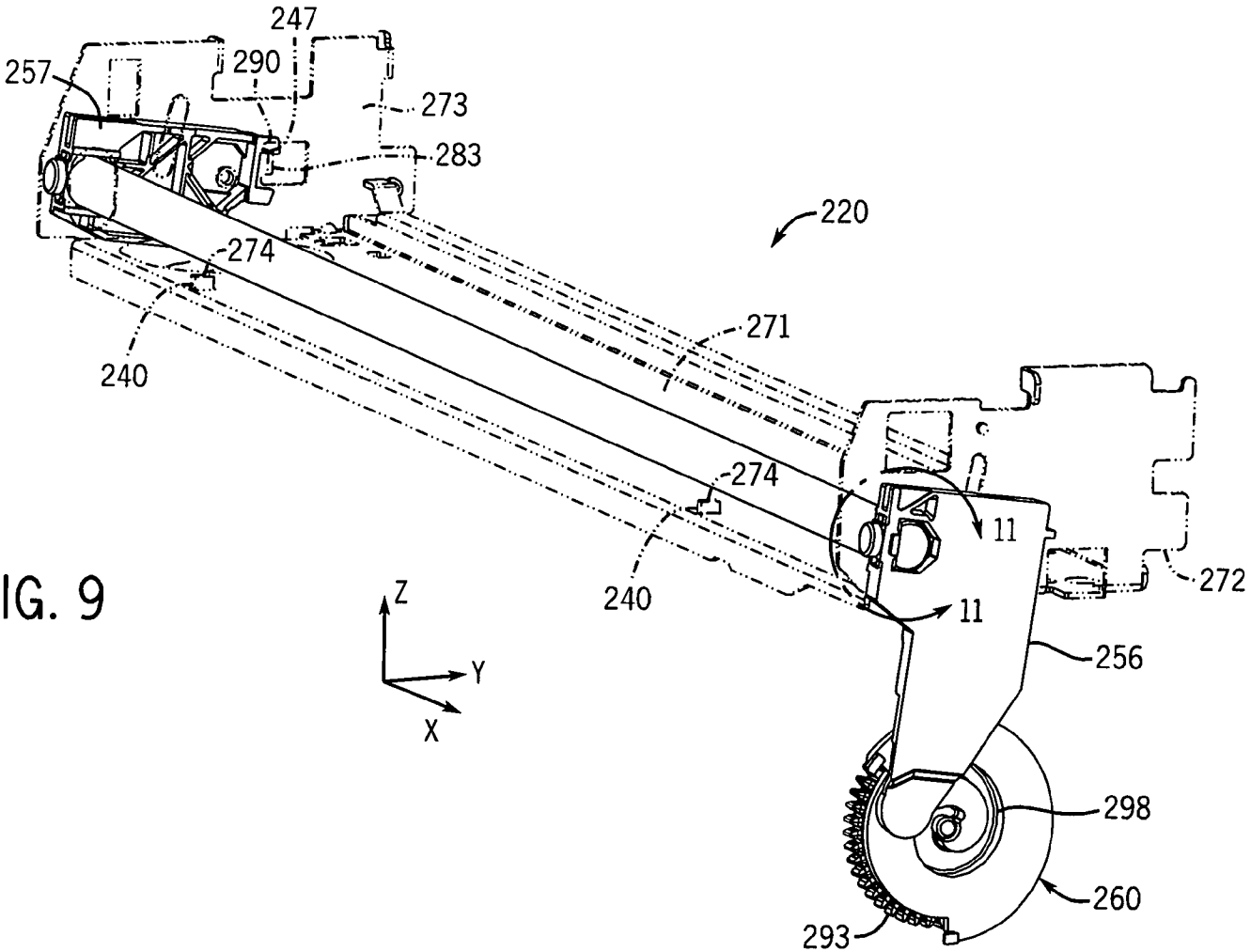
FIG. 9 is an isometric perspective view of a portion of the printing system of FIG. 3 illustrating levers and a carriage rod in a raised position according to an example embodiment.
Figure 10:
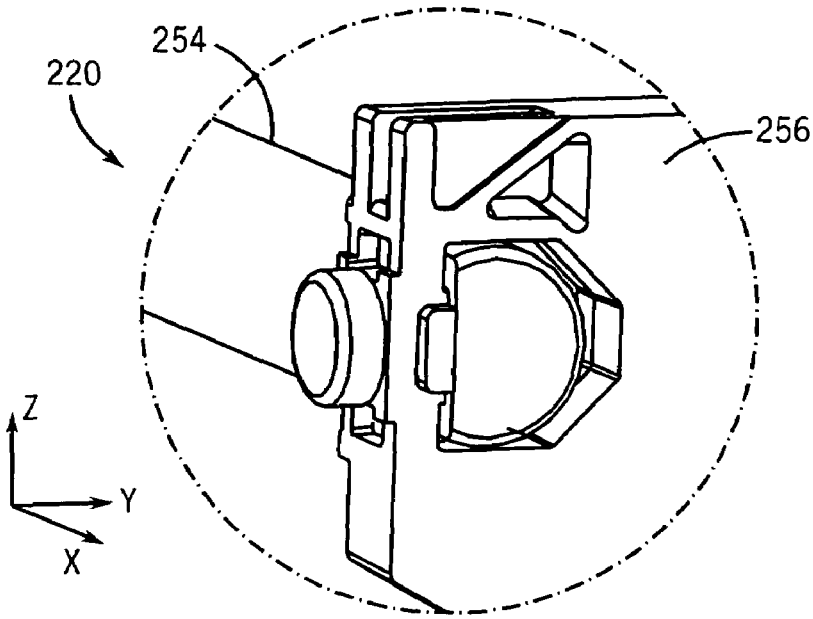
FIG. 10 is an enlarged perspective view of the printing system of FIG. 8 taken along line 10-10 according to an example embodiment.
Figure 11:
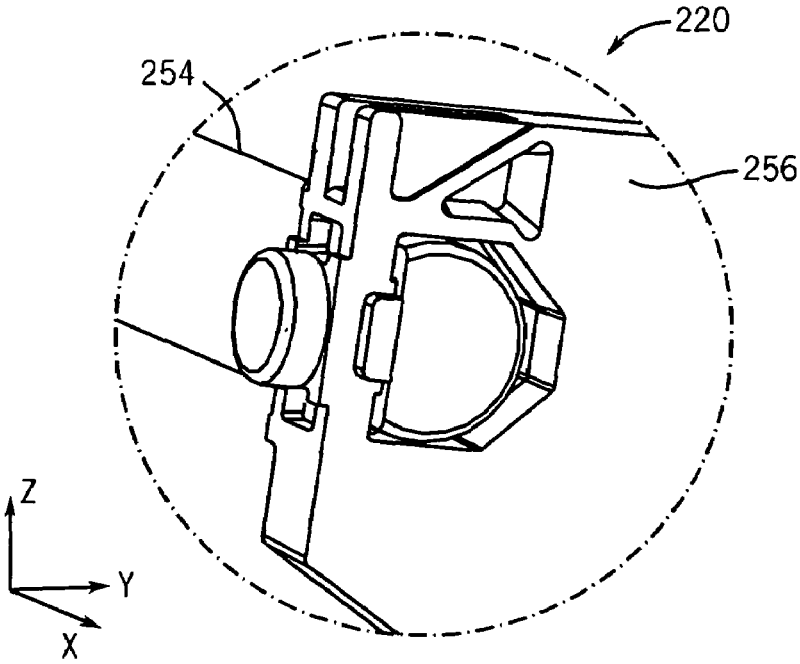
FIG. 11 is an enlarged perspective view of the printing system of FIG. 9 taken along line 11-11 according to an example embodiment.

Pivot portion 280 is configured to bear against and slide along surface 246 when lever 256 and carriage rod 254 are being raised or pivoted (as shown in FIGS. 5 and 7). Lever 256 is further configured to be disengaged from lift mechanism 260 when carriage rod 254 is resting upon surface 274. Lever 256 is configured such that pivot portion 280 disengages surface 246 when carriage rod 254 is resting upon supports 240 (as shown in FIGS. 4 and 6). Because pivot portion 280 of lever 256 disengages surface 246 when carriage rod 276 rests upon supports 240, positioning of carriage rod 254, and ultimately print cartridges 248, is largely dependent upon the location accuracy of surfaces 274 and the impact of other part or assembly tolerances upon the positioning of carriage rod 254 and print cartridges 248 is reduced. The sensitivity of the positioning of carriage rod 254 and print cartridges 248 to assembly variations and part dimension variations is further reduced because lift mechanism 260 is operably disengaged from lever 256 and carriage rod 254 when carriage rod 254 rests upon supports 240.

As shown by FIGS. 4 and 12, pivot portion 280 comprises an elongate tab or projection extending from a remainder of lever 256 through slot 281. In one embodiment, the elongate tab of projection forming to portion 280 is integrally formed as part of a single unitary body with a remainder of lever 256. In other embodiments, the projection or tab may comprise other structures otherwise joined to the remainder of lever 256.

Lever 257 comprises one or more structures fixedly secured to an opposite end of carriage rod 254 proximate to side portion 273 of frame 228. As shown by FIGS. 13 and 14, lever 257 includes pivot portion 290. Pivot portion 290 extends proximate to guide surface 247 and is configured to bear against guide surface 247 and slide along surface 247 when lever 257 and carriage rod 254 are being raised by lift mechanism 260 as shown in FIG. 14. Pivot portion 290 is further configured to be located out of engagement with surface 247 when carriage rod 254 is resting upon supports 240 as shown in FIG. 13. In the example illustrated, pivot portion 290 comprises a projection or tab extending over tab 283 providing surface to 247. In one embodiment, pivot portion 290 is integrally formed as part of a single unitary body with a remainder of lever 257. In other embodiments, pivot portion 290 may alternatively be a separate structure joined to a remainder of lever 257.

Bias members 258 comprise members operably coupled between frame 228 and levers 256, 257. Bias members 258 are configured to resiliently urge levers 256, 257 and carriage rod 254 against guide surfaces 244 (shown in FIGS. 3 and 12). As a result, during pivoting and levers 256, 257, carriage rod 254 is maintained along the substantially vertical surfaces 244 to maintain the Y-axis positioning of print cartridges 248 during raising and lowering of print cartridges 248. In one embodiment, bias members 258 comprise springs having a first portion secured to frame 228 and a second portion secured to each of levers 256, 257. In other embodiments, bias members 258 may comprise other resilient biasing mechanisms.

Lift mechanism 260 comprises a structure configured to directly engage engagement portion 279 of lever 256 to pivot lever 256 and carriage rod 254 about an axis provided by lever 256. Lift mechanism 260 is configured to disengage lever 256 when carriage rod 254 is resting upon surfaces 240. At the same time, lift mechanism 260 is configured to lift carriage rod 254 off of supports 240 to lift carriage rod 254 and print cartridges 248.

In the example illustrated, lift mechanism 260 comprises a disk rotatably supported by a stationary structure (not shown) and having peripheral teeth 293 and a spiral groove 295 serving as a cam. In other embodiments, lift mechanism 260 is supported by frame 228 or media support 230. Teeth 293 are configured to engage corresponding teeth of a gear (not shown) operably connected to media drive 232. As a result, the disk of lift mechanism 260 may be rotatably driven in either direction using power or torque received from media drive 232.

As shown by FIGS. 4 and 5, groove 295 spirally extends outward from a substantial center point and has a width larger than engagement portion 279 of lever 256. Groove 295 has an enlarged central portion 296 and an interior cam surface 298. The large central portion 296 is configured to receive portion 279 when lever 256 is pivoted so as to lower carriage rod 254 on supports 240 (shown in FIG. 3) with interior cam surface 298 out of engagement with engagement portion 279. As a result, assembly and manufacturing tolerances or variations associated with lift mechanism 260 have a reduced impact upon the positioning of carriage rod 254 and the printheads of print cartridges 248. During rotation of lift mechanism 260, cam surface 298 is rotated into engagement with engagement portion 279 such that portion 279 rides against cam surface 298, resulting in lever 256 being pivoted as shown in FIG. 5.

In the example embodiment illustrated, surface 298 is not concentric with respect to a rotational axis of lift mechanism 260. For example, surface 298 includes portions 301 which have a smaller radius and other portions 302 which have a larger relative radius and which are flatter. When engagement portion 279 is in engagement with portion 301, lever 256 will be pivoted a larger extent per angular rotation of the disk of lift mechanism 260 as compared to when engagement portion 279 is in engagement with portion 302 of cam surface 298. In the example illustrated, this facilitates faster initial lifting of carriage rod 254 and print cartridges 248 off of supports 240 (shown in FIG. 3) and facilitates steady or consistent positioning of carriage rod 254 and print cartridges 248 once appropriately raised above media support 230 (shown in FIG. 3). When engagement portion 279 of lever 256 is in contact with portion 302, lever 256 is less sensitive to inadvertent or accidental rotation or movement of lift mechanism 260, such as that resulting from vibration. Also, when engagement portion 279 of lever 256 is in contact with portion 302, it is less likely that lift mechanism 260 will rotate out of position when disengaged from media drive 232. Lift mechanism 260 may also contain detents to prevent it from rotating out of position when disengaged from media drive 232. In other embodiments, cam surface 298 may have other configurations.

Controller 270 (schematically shown in FIG. 3) comprises one or more processing units configured to receive signals or import from sensor 234 and input 236, to analyze such input and to generate control signals directing the operation of media drive 232 to move media relative to print cartridges 248 and to supply torque to lifting mechanism 260 to appropriately position print cartridges 248 relative to media support 230 depending upon a desired spacing of the printheads of print cartridges 248 with respect to media support 230 and the medium to be printed upon. FIGS. 4, 6, 8, 10 and 13 illustrate printing system to 20 when print cartridges 248 are in their lowermost position in which the printheads of print cartridges are closest to media support 230 (shown in FIG. 3). In this position, enhanced print performance may be achieved due to the close proximity of the printheads to the media being printed upon. In this position, carriage rod 254 rests upon supports 240 as seen in FIG. 3, engagement portion 279 of lever 256 is out of engagement with lift mechanism 260 as seen in FIG. 4 and portion 280 is out of engagement with guide surface 246 as seen in FIGS. 4 and 6. In this position, pivot portion 290 of lever 257 is also out of engagement with guide surface 247. As a result, the positioning of print cartridges 248 is less affected by part and assembly variations pertaining to lift mechanism 260, components connected to lift mechanism 260, frame 228 or components connected to frame 228.

FIGS. 5, 7, 11, 12 and 14 illustrate levers 256 and 257 pivoted by lift mechanism 260 to lift or elevate carriage rod 254 above supports 240 (shown in FIG. 3) to lift or elevate the printheads of print cartridges 248 further above media support 230 to facilitate printing upon thicker media. To elevate carriage rod 254 and the associated print cartridges 248, controller 270 generates control signals directing media drive 232 to rotate lift mechanism 260 in a clockwise direction as seen in FIG. 4. Initial rotation of mechanism 260 moves cam surface 298 into engagement with engagement portion 279 of lever 256. Further rotation of mechanism 260 begins pivoting of lever 256 until the portion 280 is pivoted from the position shown in FIG. 6 to the position shown in FIG. 7. During such pivoting of lever 256, pivot portion 280 slides against guide surface 246 in the direction indicated by arrow 305 in FIG. 12. During pivoting of lever 256, bias member 258 along side portion 272 maintains carriage rod 254 against guide surface 244 to maintain Y-axis positioning of carriage rod 254.

As lever 256 and carriage rod 254 are rotated or pivoted about axis 276, lever 257 also pivots. Initial pivoting of lever 257 moves pivot portion 290 from the position shown in FIG. 13 to the position shown in FIG. 14. During such pivoting, portion 290 is brought into engagement with guide surface 247. Further rotation of carriage rod 254 and pivoting of lever 257 results in pivot portion 290 sliding against guide surface 247 in the direction indicated by arrow 307 while bias member 258 maintains carriage rod 254 against guide surface 244 proximate side portion 273 of frame 228 and maintains the Y-axis positioning of carriage rod 254 and print cartridges 248. In the embodiment illustrated, lever 257 is longer than lever 256 and therefore lifts carriage rod 254 at a faster rate than lever 256 to compensate for extra lost motion between pivot portion 290 and guide surface 247 to allow for manufacturing tolerances between levers 256 and lever 257. In other embodiments, lever 257 may be the same length or shorter than lever 256. Upon desired positioning of carriage rod 254 and print cartridges 248, controller 270 generates control signals directing print cartridges 248 to selectively eject ink or other fluid upon the print medium.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a support;

a printhead movable between a raised position elevated above and off of the support and a lowered position in which the print head rests upon the support; and a lift mechanism configured to lift the printhead to the raised position and to operably disengage the printhead when the printhead is resting upon the support, wherein the lift mechanism is configured to derive power from a media drive.

2. The apparatus of claim 1 further comprising:

a frame;

a rod supporting the printhead; and a first lever coupled to the rod and configured to vertically engage the frame when the printhead is iii the raised position and to vertically disengage the frame when the printhead is resting upon the support.

3. The apparatus of claim 1 further comprising:

a frame;

a rod supporting the frame; and a first lever coupled to the rod, wherein the lift mechanism is configured to engage the lever when the printhead is in the raised position and to disengage the lever when the printhead is resting upon the support.

4. The apparatus of claim 3 further comprising a second lever coupled to the rod at an opposite end of the rod and configured to vertically engage the frame when the printhead is in the raised position and to vertically disengage the frame when the printhead is resting upon the support.

5. The apparatus of claim 1, wherein the lift mechanism comprises a spiral cam and wherein the apparatus further comprises:

a rod supporting the printhead; and a lever connected to and extending from the rod, the lever riding against and moving relative to the spiral cam, wherein rotation of the spiral cam pivots the lever.

6. The apparatus of claim 1, wherein the printhead is supported so as to linearly move between the lowered position and the raised position.

7. The apparatus of claim 1 further comprising:

a frame; and a rod supporting the printhead, wherein the rod is pivotable about an axis to raise and lower the rod and the printhead and wherein an axis about which the rod pivots is movable in a horizontal direction relative to the frame to reduce horizontal movement of the rod during vertical movement of the rod.

8. The apparatus of claim 1 further comprising:

a rod supporting the printhead;

a vertical surface adjacent to the rod so as to constrain horizontal movement of the rod as the rod is vertically moved;

a lever coupled to the rod; and a horizontal surface, wherein the lever is configured to pivot against the surface and is configured to slide along the surface, permitting vertical movement of the rod and reducing horizontal movement of the rod.

9. The apparatus of claim 8 further comprising a bias member resiliently urging the rod against the vertical surface.

10. The apparatus of claim 8 further comprising a carriage pivotably coupled to the rod and supporting the printhead.

11. The apparatus of claim 10 further comprising a horizontal surface against and along which the carriage rests and slides.

12. The apparatus of claim 10 further comprising a vertical surface against which and along which the carriage slides.

13. An apparatus comprising:

a support;

a printhead movable between a raised position and a lowered position in which the print head rests upon the support;

a lift mechanism configured to lift the printhead to the raised position and to operably disengage the printhead when the printhead is resting upon the support;

a frame;

a rod supporting the frame;

a first lever coupled to the rod, wherein the lift mechanism is configured to engage the lever when the printhead is in the raised position and to disengage the lever when the printhead is resting upon the support; and a second lever coupled to the rod at an opposite end of the rod and configured to vertically engage the frame when the printhead is in the raised position and to vertically disengage the frame when the printhead is resting upon the support.

14. The apparatus of claim 13, wherein the lift mechanism is configured to derive power from a media drive.

15. An apparatus comprising:

a support;

a printhead movable between a raised and a lowered position in which the print head rests upon the support; and a lift mechanism configured to lift the printhead to the raised position and to operably disengage the printhead when the printhead is resting upon the support;

a rod supporting the printhead;

a vertical surface adjacent to the rod so as to constrain horizontal movement of the rod as the rod is vertically moved;

a lever coupled to the rod; and a horizontal surface, wherein the lever is configured to pivot against the surface and is configured to slide along the surface, permitting vertical movement of the rod and reducing horizontal movement of the rod.

16. The apparatus of claim 15 further comprising a bias member resiliently urging the rod against the vertical surface.

17. The apparatus of claim 15 further comprising a carriage pivotably coupled to the rod and supporting the printhead.

18. The apparatus of claim 17 further comprising a horizontal surface against and along which the carriage rests and slides.

19. The apparatus of claim 17 further comprising a vertical surface against which and along which the carriage slides.

* * * * *

UNITED STATES PATENT AND TRADEMARK OFFICE

CERTIFICATE OF CORRECTION

PATENT NO. : 7,645,006 B2
APPLICATION NO. : 11/494923
DATED : January 12, 2010
INVENTOR(S) : Wesley R. Schalk et al.

It is certified that error appears in the above-identified patent and that said Letters Patent is hereby corrected as shown below:

In column 13, line 25, in Claim 2, delete "iii" and insert -- in --, therefor.

Signed and Sealed this

Sixth Day of July, 2010

David J. Kappos

David J. Kappos
*Director of the United States Patent and Trademark Office*